US009437144B2

(12) United States Patent
Chen et al.

(10) Patent No.: US 9,437,144 B2
(45) Date of Patent: Sep. 6, 2016

(54) LIQUID CRYSTAL DISPLAY PANEL, IMAGE DISPLAYING METHOD AND IMAGE DISPLAYING SYSTEM

(71) Applicant: Shenzhen China Star Optoelectronics Technology Co., Ltd., Shenzhen, Guangdong (CN)

(72) Inventors: Lixuan Chen, Guangdong (CN); Chih-tsung Kang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 243 days.

(21) Appl. No.: 14/363,303

(22) PCT Filed: May 14, 2014

(86) PCT No.: PCT/CN2014/077488

§ 371 (c)(1),
(2) Date: Jun. 6, 2014

(87) PCT Pub. No.: WO2015/172336

PCT Pub. Date: Nov. 19, 2015

(65) Prior Publication Data

US 2015/0325183 A1 Nov. 12, 2015

(30) Foreign Application Priority Data

May 12, 2014 (CN) ..... 2014 1 0197097

(51) Int. Cl.
*G09G 3/36* (2006.01)
*G09G 5/00* (2006.01)

(52) U.S. Cl.
CPC ..... *G09G 3/3607* (2013.01); *G09G 5/005* (2013.01); *G09G 2300/0452* (2013.01); *G09G 2340/06* (2013.01)

(58) Field of Classification Search
CPC ..... G09G 3/2003; G09G 3/2074; G09G 3/3607; G09G 5/005; G09G 5/02; G09G 5/026; G09G 2300/0439; G09G 2300/0443; G09G 2300/0452; G09G 2320/0666; G09G 2340/06; G02F 2201/52; H04N 1/56; H04N 1/6005; H04N 1/6008; H04N 1/6022; H04N 1/6058; H04N 1/644
See application file for complete search history.

(56) References Cited

U.S. PATENT DOCUMENTS

2007/0070086 A1* 3/2007 Brown Elliott ..... G09G 5/02 345/613
2008/0165204 A1* 7/2008 Klompenhouwer . G09G 3/3413 345/589
2009/0027425 A1* 1/2009 Park ..... G09G 3/3607 345/690

(Continued)

*Primary Examiner* — Keith Crawley
(74) *Attorney, Agent, or Firm* — Andrew C. Cheng

(57) ABSTRACT

The present invention relates to an image displaying method including: providing a liquid crystal display panel with multiple three-pixel display units, each three-pixel display unit including a first red sub-pixel unit, a first green sub-pixel unit and a first blue sub-pixel unit; demarcating a display region of the liquid crystal display panel to form multiple four-pixel display units, each four-pixel display unit including four the three-pixel display units; and providing four-pixel data signals of image including a red pixel data signal, a green pixel data signal, a blue pixel data signal and a fourth pixel data signal inputted to the liquid crystal display panel and thereby displaying the image thereon. The present invention also provides an image displaying system for carrying out the image displaying method.

18 Claims, 1 Drawing Sheet

(56) References Cited

U.S. PATENT DOCUMENTS

2010/0118045 A1* 5/2010 Brown Elliott .... G02B 27/2214 345/589

2013/0120472 A1* 5/2013 Byun ..... G09G 5/02 345/690

* cited by examiner

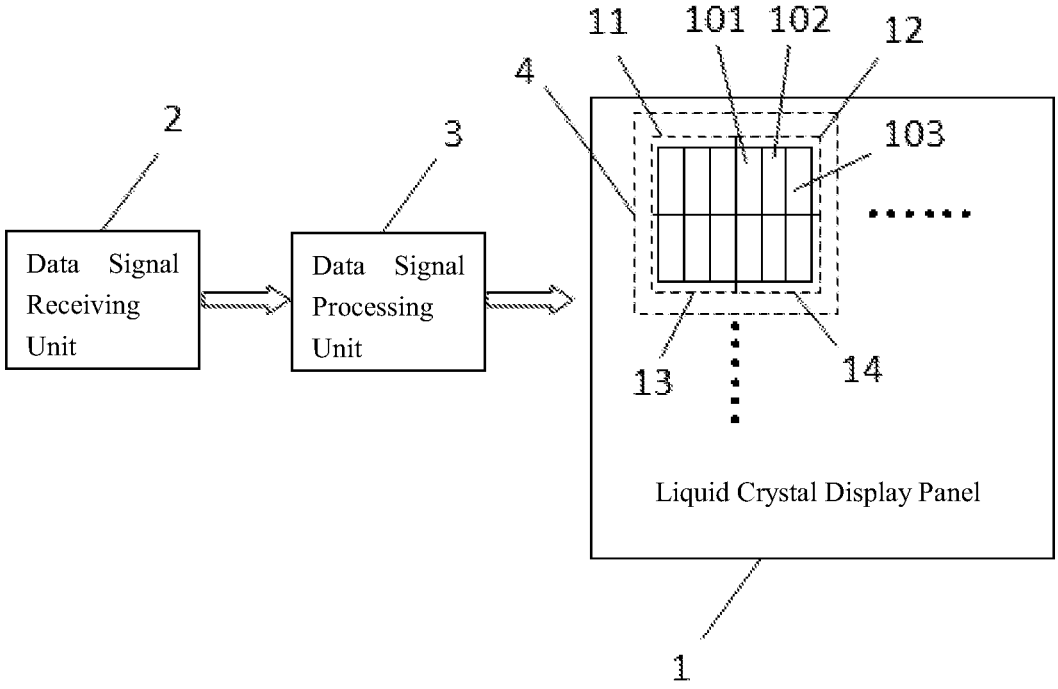
11
101
102
12
4
2
3
103
Data Signal Receiving Unit
Data Signal Processing Unit
13
14
Liquid Crystal Display Panel
1

LIQUID CRYSTAL DISPLAY PANEL, IMAGE DISPLAYING METHOD AND IMAGE DISPLAYING SYSTEM

TECHNICAL FIELD

The present invention relates to the field of liquid crystal display, and particularly to an image displaying method and an image displaying system.

DESCRIPTION OF RELATED ART

Nowadays, in the image display apparatus such as a liquid crystal display (LCD) panel or an organic light emitting diode (OLED) display panel, a red (R) sub-pixel unit, a green (G) sub-pixel unit and a blue (B) sub-pixel unit are together to constitute one pixel display unit, by controlling a gray scale of each sub-pixel unit to mix a color wanted to be displayed and thereby displaying a color image. With the development of information technology, various requirements of display panel are increasing, high transmittance, low power consumption and high image quality are becoming the demands of people to the display panel. The transmittance and mixing efficiency of the conventional RGB three primary color mixing display manner are relatively low, resulting in the power consumption of display panel is high, which restricts the product optimization of display panel. Accordingly, it has been proposed that a red (R) sub-pixel unit, a green (G) sub-pixel unit, a blue (B) sub-pixel unit and a fourth sub-pixel unit are together to constitute a four-pixel display unit, so as to improved the display quality of RGB display panel.

It is common that the added fourth sub-pixel unit is a white (W) sub-pixel unit or a yellow (Y) sub-pixel unit, and thereby constituting a RGBW four-pixel display unit or a RGBY four-pixel display unit. Advantages of adopting the RGBW four-pixel display are that: (1) resolution of sub-pixel is increased with 1/4, (2) transmittance of pixel is increased with 50%, and (3) color of RGBW is more than that of RGB with 11/16. Advantages of adopting the RGBY four-pixel display are that: the display panel adopting such technology not only can display vivid colors such as yellow and gold which are difficult to be reproduced by the traditional RGB three primary color mixing display manner, but also can give a better enhancement effect to blue color performance owning to the enhancement of yellow as the complementary color of blue.

A current transmission interface of data signals generally is a transmission interface for RGB three-pixel, if data signals for RGB three-pixel are directly applied to the display panel with four-pixel display unit, which would result in image distortion, and therefore it is necessary to convert the RGB three-pixel data signals into four-pixel data signals. As to the conversion from three-pixel data signals to four-pixel data signals, there are various different conversion algorithms have been proposed. However, since the design of hardware chip for data signals conversion relies on the conversion algorithm, a simulation evaluation to the conversion algorithm is needed to be carried out before designing the hardware chip, so as to ensure the design quality of hardware chip.

SUMMARY

In view of the shortcomings of prior art, an objective of the present invention is to provide an image displaying method and an image displaying system, by means of displaying an image expressed by four-pixel data signals on a conventional RGB three-pixel liquid crystal display panel to evaluate a conversion algorithm of converting a RGB three-pixel data signals into the four-pixel data signals, so as to realize a simulation evaluation of the conversion algorithm before a design of hardware chip and accordingly the design quality of hardware chip is ensured.

In order to achieve the objective, the present invention proposes the following technical schemes.

An image displaying method in an exemplary embodiment includes:

providing a liquid crystal display panel, wherein the liquid crystal display panel includes a plurality of three-pixel display unit, each three-pixel display unit includes a first red sub-pixel unit, a first green sub-pixel unit and a first blue sub-pixel unit;

demarcating a display region of the liquid crystal display panel to define a plurality of four-pixel display units, wherein each four-pixel display unit includes four the three-pixel display units, and the four three-pixel display units are respectively corresponding as a second red sub-pixel unit, a second green sub-pixel unit, a second blue sub-pixel unit and a fourth sub-pixel unit; and providing four-pixel data signals of an image, wherein the four-pixel data signals includes a red pixel data signal, a green pixel data signal, a blue pixel data signal and a fourth pixel data signal respectively inputted to the second red sub-pixel unit, the second green sub-pixel unit, the second blue sub-pixel unit and the fourth sub-pixel unit, and thereby displaying the image on the liquid crystal display panel.

In an exemplary embodiment, the fourth pixel data signal is a white pixel data signal or a yellow pixel data signal, and correspondingly the four-pixel data signals are RGBW data signals or RGBY data signals.

In an exemplary embodiment, the four three-pixel display units in the four-pixel display unit are arranged in a rectangle form or in a strip form.

In an exemplary embodiment, the red pixel data signal is inputted to the first red sub-pixel unit of the second red sub-pixel unit, the green pixel data signal is inputted to the first green sub-pixel unit of the second green sub-pixel unit, the blue pixel data signal is inputted to the first blue sub-pixel unit of the second blue sub-pixel unit, and the fourth pixel data signal is inputted to the first red sub-pixel unit, the first green sub-pixel unit and the first blue sub-pixel unit of the fourth sub-pixel unit. A gray scale of the fourth pixel data signal $X(gray)=a\times R(gray)+b\times G(gray)+c\times B(gray)$, where R(gray), G(gray) and B(gray) respectively represent gray scales of the red pixel data signal, the green pixel data signal and the blue pixel data signal, and a, b, c are constant.

In an exemplary embodiment, a calculating process of the gray scale X(gray) of the fourth pixel data signal includes:

firstly setting a luminance of the fourth pixel data signal $Lv(X)=k\times(Lv(R)+Lv(G)+Lv(B))$ and a chrominance of the fourth pixel data signal $x(X)=f(x(R)+x(G)+x(B))$, $y(X)=f(y(R)+y(G)+y(B))$; and afterwards carrying out a white balance calculation to obtain the gray scale of the fourth pixel data signal $X(gray)=a\times R(gray)+b\times G(gray)+c\times B(gray)$, where, f is a function representative of converting three-pixel data signals of image into four-pixel data signals of image;

Lv(R), Lv(G) and Lv(B) respectively represent luminance of the red pixel data signal, the green pixel data signal and the blue pixel data signal;

x(R), x(G) and x(B) respectively represent horizontal coordinate values in the chromaticity coordinates system of the red pixel data signal, the green pixel data signal and the blue pixel data signal, y(R), y(G) and y(B) respectively represent longitudinal coordinate values in the chromaticity coordinates system of the red pixel data signal, the green pixel data signal and the blue pixel data signal.

An image displaying system in an exemplary embodiment of the present invention includes:

a liquid crystal display panel, wherein the liquid crystal display panel includes a plurality of three-pixel display units, each three-pixel display unit includes a first red sub-pixel unit, a first green sub-pixel unit and a first blue sub-pixel unit; the liquid crystal display panel further are defined with a plurality of four-pixel display units, each four-pixel display unit includes four the three-pixel display units, and the four three-pixel display units are respectively corresponding as a second red sub-pixel unit, a second green sub-pixel unit, a second blue sub-pixel unit and a fourth sub-pixel unit;

a data signal receiving unit, configured for receiving three-pixel data signals of an image, wherein the three-pixel data signals includes a red pixel data signal, a green pixel data signal and a blue pixel data signal;

a data signal processing unit, coupled to the data signal receiving unit and configured for simulating four-pixel data signals of the image according to the three-pixel data signals of the image including according to luminance and chrominance of the red pixel data signal, the green pixel data signal and the blue pixel data signal to generate gray scales of a red pixel data signal, a green pixel data signal and a blue pixel data signal and to calculate a gray scale of a fourth pixel data signal; wherein the gray scale of the fourth pixel data signal $X(gray)=a\times R(gray)+b\times G(gray)+c\times B(gray)$, where R(gray), G(gray) and B(gray) respectively represent the gray scales of the red pixel data signal, the green pixel data signal and the blue pixel data signal, and a, b, c are constant;

wherein the liquid crystal display panel is coupled to the data signal processing unit and for displaying the image according to the gray scales of the red pixel data signal, the green data signal, the blue data signal and the fourth pixel data signal.

In an exemplary embodiment, the fourth pixel data signal is a white pixel data signal or a yellow pixel data signal, and correspondingly the four-pixel data signals are RGBW data signals or RGBY data signals.

In an exemplary embodiment, the four three-pixel display units in the four-pixel display unit are arranged in a rectangle form or in a strip form.

In an exemplary embodiment, the red pixel data signal is inputted to the first red sub-pixel unit of the second red sub-pixel unit, the green pixel data signal is inputted to the first green sub-pixel unit of the second green sub-pixel unit, the blue pixel data signal is inputted to the first blue sub-pixel unit of the second blue sub-pixel unit, and the fourth pixel data signal is inputted to the first red sub-pixel unit, the first green sub-pixel unit and the first blue sub-pixel unit of the fourth sub-pixel unit.

In an exemplary embodiment, a calculating process of a gray scale X(gray) of the fourth pixel data signal carried out by the data signal processing unit includes:

firstly setting a luminance of the fourth pixel data signal $Lv(X)=k\times(Lv(R)+Lv(G)+Lv(B))$ and a chrominance of the fourth pixel data signal $x(X)=f(x(R)+x(G)+x(B))$, $y(X)=f(y(R)+y(G)+y(B))$; and afterwards carrying out a white balance calculation to obtain the gray scale of the fourth pixel data signal $X(gray)=a\times R(gray)+b\times G(gray)+c\times B(gray)$, where, f is a function representative of converting three-pixel data signals of the image into four-pixel data signals of the image;

Lv(R), Lv(G) and Lv(B) respectively represent luminance of the red pixel data signal, the green pixel data signal and the blue pixel data signal;

x(R), x(G) and x(B) respectively represent horizontal coordinate values in the chromaticity coordinates system of the red pixel data signal, the green pixel data signal and the blue pixel data signal, y(R), y(G) and y(B) respectively represent longitudinal coordinate values in the chromaticity coordinates system of the red pixel data signal, the green pixel data signal and the blue pixel data signal.

Compared with the prior art, the image displaying method and the image displaying system proposed by the present invention, by means of displaying an image expressed by four-pixel data signals on a conventional RGB three-pixel liquid crystal display panel to evaluate a conversion algorithm of converting RGB three-pixel data signals into the four-pixel data signals, so as to realize a simulation evaluation of the conversion algorithm before a design of hardware chip and accordingly the design quality of hardware chip is ensured.

BRIEF DESCRIPTION OF THE DRAWINGS

The above embodiments will become more readily apparent to those ordinarily skilled in the art after reviewing the following detailed description and accompanying drawings.

FIG. 1 is a schematic structural diagram of an image displaying system in accordance with an exemplary embodiment of the present invention.

DETAILED DESCRIPTION OF EMBODIMENTS

The present invention will now be described more specifically with reference to the following embodiments. It is to be noted that the following descriptions of embodiments are presented herein for purpose of illustration and description only. It is not intended to be exhaustive or to be limited to the precise form disclosed.

Referring to FIG. 1, an image displaying system in accordance with an exemplary embodiment includes a liquid crystal display panel 1, a data signal receiving unit 2 and a data signal processing unit 3.

The liquid crystal display panel 1 includes a plurality of three-pixel display units 11, 12, 13, 14. Each of the three-pixel display units 11, 12, 13, 14 includes a first red sub-pixel unit 101, a first green sub-pixel unit 102 and a first blue sub-pixel unit 103. Moreover, the liquid crystal display panel 1 includes a plurality of four-pixel display unit 4. Each of the four-pixel display units 4 includes four the three-pixel display units. The four three-pixel display units respectively are corresponding as a second red sub-pixel unit 11, a second green sub-pixel unit 12, a second blue sub-pixel unit 13 and a fourth sub-pixel unit 14.

The data signal receiving unit 2 is configured (i.e., structured and arranged) for receiving three-pixel data signals of an image. The three-pixel data signals of the image include a red pixel data signal, a green pixel data signal and a blue pixel data signal.

The data signal processing unit 3 is coupled to the data signal receiving unit 2 and configured for simulating four-pixel data signals of the image according to the three-pixel data signals of the image. Specifically, the data signal processing unit 3 generate gray scales of a red pixel data signal, a green pixel data signal and a blue pixel data signal and calculates a gray scale of a fourth pixel data signal according to luminance and chrominance of the red pixel data signal, the green pixel data signal and the blue pixel data signal of the three-pixel data signals of the image. The gray scale of the fourth pixel data signal is X(gray)=a×R(gray)+b×G(gray)+c×B(gray), where R(gray), G(gray) and B(gray) respectively represent the gray scales of the red pixel data signal, the green pixel data signal and the blue pixel data signal, and a, b, c are constant.

The liquid crystal display panel 1 is coupled to the data signal processing unit 3 and configured for receiving the gray scales of the red pixel data signal, the green pixel data signal, the blue pixel data signal and the fourth pixel data signal to display the image.

In this embodiment, the fourth pixel data signal is a white pixel data signal, and correspondingly the four-pixel data signals of the image are RGBW data signals. In other embodiments, the fourth pixel data signal may be a yellow pixel data signal instead, and correspondingly the four-pixel data signals of the image are RGBY data signals.

In this embodiment, the four pixels 11, 12, 13, 14 in each four-pixel display unit 4 are arranged in a rectangle form. In other embodiments, the four pixels 11, 12, 13, 14 in each four-pixel display unit 4 may be arranged in a strip form instead.

An image displaying method of the above-described image displaying system includes several steps will be described below in detail.

Firstly, three-pixel (RGB) data signals of an image are inputted to the data signal receiving unit 3. The three-pixel data signals include a red (R) pixel data signal, a green (G) pixel data signal and a blue (B) pixel data signal.

Afterwards, the data signal processing unit 3 simulates four-pixel data signals of the image according to the three-pixel (RGB) data signals of the image. In this embodiment, simulated RGBW data signals are taken as an example, but the image displaying method in this embodiment also can be applied to the situation of simulating RGBY data signals according to RGB data signals. More specifically, the data signal processing unit 3 generates gray scales (R(gray), G(gray), B(gray)) of a red pixel data signal, a green pixel data signal and a blue pixel data signal and calculates a gray scale W(gray) of a white pixel data signal according to luminance (Lv(R), Lv(G), Lv(B)) and chrominance (x(R), y(R), x(G), y(G), x(B), y(B)) of the red pixel data signal, the green pixel data signal and the blue pixel data signal of the three-pixel RGB data signals. A process of the data signal processing unit 3 calculating the gray scale W(gray) of the white pixel data signal includes the following steps (a) and (b).

(a): a luminance of the white pixel data signal is set to be Lv(W)=k×(Lv(R)+Lv(G)+Lv(B)), and a chrominance of the white pixel data signal is set to be x(W)=f(x(R)+x(G)+x(B)), y(W)=f(y(R)+y(G)+y(B)).

(b): afterwards, a white balance calculation is carried out to obtain the gray scale W(gray) of the white pixel data signal, where W(gray)=a×R(gray)+b×G(gray)+c×B(gray). That is, three sub-pixels (RGB) in the three-pixel display panel together are used to express one sub-pixel (W) of four-pixel.

In the above equations, k is a coefficient. f is a function representative of converting three-pixel data signals of the image into four-pixel data signals of the image and may be any one published conversion function from RGB to RGBW in the prior art. The x(R), x(G) and x(B) respectively represent horizontal coordinate values in the chromaticity coordinates system of the red pixel data signal, the green pixel data signal and the blue pixel data signal of the three-pixel RGB data signals of the image. The y(R), y(G) and y(B) respectively represent longitudinal coordinate values in the chromaticity coordinates system of the red pixel data signal, the green pixel data signal and the blue pixel data signal of the three-pixel RGB data signals of the image. The a, b, c are constant.

Finally, the liquid crystal display panel 1 receives the gray scales of the red pixel data signal, the green pixel data signal and the blue pixel data signal and the gray scale of the white pixel data signal of the four-pixel RGBW data signals of the image outputted from the data signal processing unit 3, and thereby displays the image. Specifically, the gray scale of the red pixel data signal is inputted to the first red sub-pixel unit 101 of the second red sub-pixel unit 11 and at this time the first green sub-pixel unit 102 and first blue sub-pixel unit 103 of the second red sub-pixel unit 11 have no data signal inputted thereto. The gray scale of the green pixel data signal is inputted to the first green sub-pixel unit 102 of the second green sub-pixel unit 12 and at this time the first red sub-pixel unit 101 and the first blue sub-pixel unit 103 of the second green sub-pixel unit 12 have no data signal inputted thereto. The gray scale of the blue pixel data signal is inputted to the first blue sub-pixel unit 103 of the second blue sub-pixel unit 13 and at this time the first red sub-pixel unit 101 and the first green sub-pixel unit 102 of the second blue sub-pixel unit 13 have no data signal inputted thereto. The gray scale of the white pixel data signal is inputted to the first red sub-pixel unit 101, the first green sub-pixel unit 102 and the first blue sub-pixel unit 103 of the fourth sub-pixel unit 14.

In summary, the image displaying method and image displaying system in accordance with the present invention display an image expressed by four-pixel data signals on a conventional RGB three-pixel liquid crystal display panel, so as to evaluate the conversion algorithm of converting RGB three-pixel data signals into four-pixel data signals and thereby realizing the simulation evaluation of conversion algorithm before the design of hardware chip. Accordingly, the design quality of hardware chip is ensured.

It is indicated that, in this specification, the relational terminologies such as "first" and "second" only are intended to discriminate an entity or operation from another entity or operation, and not necessarily to require or imply these entities or operations having actual relationships or orders existed therebetween. Moreover, the terminology of "including", "containing" or variations thereof is meant to cover non-exclusive inclusion, so that a process, method, article or apparatus including a series of items not only includes listed items but also includes other item(s) not being explicitly listed or inherent item(s) of the process, method, article or apparatus. In the absence of more restrictive conditions, the item limited by the phraseology "including one" does not exclude the existence of additional identical item(s) in the process, method, article or apparatus including the item.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An image displaying method, comprising:

providing a liquid crystal display panel, wherein the liquid crystal display panel comprises a plurality of three-pixel display units, each of the plurality of three-pixel display units comprises a first red sub-pixel unit, a first green sub-pixel unit and a first blue sub-pixel unit;

demarcating a display region on the liquid crystal display panel to form a plurality of four-pixel display units, wherein each of the plurality of four-pixel display units comprises four of the three-pixel display units, and the four three-pixel display units are a second red sub-pixel unit, a second green sub-pixel unit, a second blue sub-pixel unit, and a fourth sub-pixel unit, respectively;

providing four-pixel data signals of an image comprising a red pixel data signal, a green pixel data signal, a blue pixel data signal and a fourth pixel data signal respectively inputted to the second red sub-pixel unit, the second green sub-pixel unit, the second blue sub-pixel unit and the fourth sub-pixel unit, and thereby displaying the image on the liquid crystal display panel.

2. The image displaying method according to claim 1, wherein the fourth pixel data signal is a white pixel data signal or a yellow pixel data signal, and correspondingly the four-pixel data signals are RGBW data signals or RGBY data signals.

3. The image displaying method according to claim 2, wherein the four three-pixel display units in the four-pixel display unit are arranged in a rectangle form or in a strip form.

4. The image displaying method according to claim 1, wherein the red pixel data signal is inputted to the first red sub-pixel unit of the second red sub-pixel unit, the green pixel data signal is inputted to the first green sub-pixel unit of the second green sub-pixel unit, the blue pixel data signal is inputted to the first blue sub-pixel unit of the second blue sub-pixel unit, and the fourth pixel data signal is inputted to the first red sub-pixel unit, the first green sub-pixel unit and the first blue sub-pixel unit of the fourth sub-pixel unit; the gray scale of the fourth pixel data signal $X(gray)=a\times R(gray)+b\times G(gray)+c\times B(gray)$, where R(gray), G(gray) and B(gray) respectively represent gray scales of the red pixel data signal, the green pixel data signal and the blue pixel data signal, and a, b, c are constant.

5. The image displaying method according to claim 4, wherein a calculating process of the gray scale X(gray) of the fourth pixel data signal comprises:

firstly setting a luminance of the fourth pixel data signal $Lv(X)=k\times(Lv(R)+Lv(G)+Lv(B))$ and a chrominance of the fourth pixel data signal $x(X)=f(x(R)+x(G)+x(B))$, $y(X)=f(y(R)+y(G)+y(B))$; and afterwards, carrying out a white balance calculation to obtain the gray scale of the fourth pixel data signal $X(gray)=a\times R(gray)+b\times G(gray)+c\times B(gray)$, where, f is a function representative of converting three-pixel data signals of the image into four-pixel data signals of the image;

Lv(R), Lv(G) and Lv(B) respectively represent a red pixel data signal, a green pixel data signal and a blue pixel data signal;

x(R), x(G) and x(B) respectively represent horizontal coordinate values in the chromaticity coordinates system of the red pixel data signal, the green pixel data signal and the blue pixel data signal, y(R), y(G) and y(B) respectively represent longitudinal coordinate values in the chromaticity coordinates system of the red pixel data signal, the green pixel data signal and the blue pixel data signal.

6. The image displaying method according to claim 2, wherein the red pixel data signal is inputted to the first red sub-pixel unit of the second red sub-pixel unit, the green pixel data signal is inputted to the first green sub-pixel unit of the second green sub-pixel unit, the blue pixel data signal is inputted to the first blue sub-pixel unit of the second blue sub-pixel unit, and the fourth pixel data signal is inputted to the first red sub-pixel unit, the first green sub-pixel unit and the first blue sub-pixel unit of the fourth sub-pixel unit; the gray scale of the fourth pixel data signal $X(gray)=a\times R(gray)+b\times G(gray)+c\times B(gray)$, where R(gray), G(gray) and B(gray) respectively represent gray scales of the red pixel data signal, the green pixel data signal and the blue pixel data signal, and a, b, c are constant.

7. The image displaying method according to claim 6, wherein a calculating process of the gray scale X(gray) of the fourth pixel data signal comprises:

firstly setting a luminance of the fourth pixel data signal $Lv(X)=k\times(Lv(R)+Lv(G)+Lv(B))$ and a chrominance of the fourth pixel data signal $x(X)=f(x(R)+x(G)+x(B))$, $y(X)=f(y(R)+y(G)+y(B))$; and afterwards, carrying out a white balance calculation to obtain the gray scale of the fourth pixel data signal $X(gray)=a\times R(gray)+b\times G(gray)+c\times B(gray)$, where, f is a function representative of converting three-pixel data signals of the image into four-pixel data signals of the image;

Lv(R), Lv(G) and Lv(B) respectively represent a red pixel data signal, a green pixel data signal and a blue pixel data signal;

x(R), x(G) and x(B) respectively represent horizontal coordinate values in the chromaticity coordinates system of the red pixel data signal, the green pixel data signal and the blue pixel data signal, y(R), y(G) and y(B) respectively represent longitudinal coordinate values in the chromaticity coordinates system of the red pixel data signal, the green pixel data signal and the blue pixel data signal.

8. The image displaying method according to claim 3, wherein the red pixel data signal is inputted to the first red sub-pixel unit of the second red sub-pixel unit, the green pixel data signal is inputted to the first green sub-pixel unit of the second green sub-pixel unit, the blue pixel data signal is inputted to the first blue sub-pixel unit of the second blue sub-pixel unit, and the fourth pixel data signal is inputted to the first red sub-pixel unit, the first green sub-pixel unit and the first blue sub-pixel unit of the fourth sub-pixel unit; the gray scale of the fourth pixel data signal $X(gray)=a\times R(gray)+b\times G(gray)+c\times B(gray)$, where R(gray), G(gray) and B(gray) respectively represent gray scales of the red pixel data signal, the green pixel data signal and the blue pixel data signal, and a, b, c are constant.

9. The image displaying method according to claim 8, wherein a calculating process of the gray scale X(gray) of the fourth pixel data signal comprises:

firstly setting a luminance of the fourth pixel data signal $Lv(X)=k\times(Lv(R)+Lv(G)+Lv(B))$ and a chrominance of the fourth pixel data signal $x(X)=f(x(R)+x(G)+x(B))$, $y(X)=f(y(R)+y(G)+y(B))$; and afterwards, carrying out a white balance calculation to obtain the gray scale of the fourth pixel data signal $X(gray)=a\times R(gray)+b\times G(gray)+c\times B\ (gray)$, where, f is a function representative of converting three-pixel data signals of the image into four-pixel data signals of the image;

Lv(R), Lv(G) and Lv(B) respectively represent a red pixel data signal, a green pixel data signal and a blue pixel data signal;

x(R), x(G) and x(B) respectively represent horizontal coordinate values in the chromaticity coordinates system of the red pixel data signal, the green pixel data signal and the blue pixel data signal, y(R), y(G) and y(B) respectively represent longitudinal coordinate values in the chromaticity coordinates system of the red pixel data signal, the green pixel data signal and the blue pixel data signal.

10. An image displaying system, comprising:

a liquid crystal display panel, wherein the liquid crystal display panel comprises a plurality of three-pixel display units, each of the plurality of three-pixel display units comprises a first red sub-pixel unit, a first green sub-pixel unit and a first blue sub-pixel unit, and the liquid crystal display panel further is demarcated to form a plurality of four-pixel display units, each of the plurality of four-pixel display units comprises four of the three-pixel display units, and the four three-pixel display units are a second red sub-pixel unit, a second green sub-pixel unit, a second blue sub-pixel unit, and a fourth sub-pixel unit, respectively;

a data signal receiving unit, configured for receiving three-pixel data signals of an image including a red pixel data signal, a green pixel data signal and a blue pixel data signal; and a data signal processing unit, coupled to the data signal receiving unit and configured for simulating four-pixel data signals of the image according to the three-pixel data signals of the image including generating gray scales of a red pixel data signal, a green pixel data signal and a blue pixel data signal according to luminance and chrominance of the red pixel data signal, the green pixel data signal and the blue pixel data signal and thereby calculating a gray scale of a fourth pixel data signal, wherein the gray scale of the fourth pixel data signal $X(gray)=a\times R(gray)+b\times G(gray)+c\times B(gray)$, where R(gray), G(gray) and B(gray) respectively represent the gray scales of the red pixel data signal, the green pixel data signal and the blue pixel data signal, and a, b, c are constant;

wherein the liquid crystal display panel is coupled to the data signal processing unit and configured for displaying the image according to the gray scales of the red pixel data signal, the green pixel data signal, the blue pixel data signal and the fourth pixel data signal.

11. The image displaying system according to claim 10, wherein the fourth pixel data signal is a white pixel data signal or a yellow pixel data signal, and correspondingly the four-pixel data signals are RGBW data signals or RGBY data signals.

12. The image displaying system according to claim 11, wherein the four three-pixel display units in the four-pixel display unit are arranged in a rectangle form or in a strip form.

13. The image displaying system according to claim 10, wherein the red pixel data signal is inputted to the first red sub-pixel unit of the second red sub-pixel unit, the green pixel data signal is inputted to the first green sub-pixel unit of the second green sub-pixel unit, the blue pixel data signal is inputted to the first blue sub-pixel unit of the second blue sub-pixel unit, and the fourth pixel data signal is inputted to the first red sub-pixel unit, the first green sub-pixel unit and the first blue sub-pixel unit of the fourth sub-pixel unit.

14. The image displaying system according to claim 13, wherein a calculating process of the gray scale X(gray) of the fourth pixel data signal carried out by the data signal processing unit comprises:

firstly setting a luminance of the fourth pixel data signal $Lv(X)=k\times(Lv(R)+Lv(G)+Lv(B))$ and a chrominance of the fourth pixel data signal $x(X)=f(x(R)+x(G)+x(B))$, $y(X)=f(y(R)+y(G)+y(B))$; and afterwards, carrying out a white balance calculation to obtain the gray scale of the fourth pixel data signal $X(gray)=axR(gray)+b\ xG(gray)+cxB(gray)$, where, f is a function representative of converting three-pixel data signals of the image into four-pixel data signals of the image;

Lv(R), Lv(G) and Lv(B) respectively represent a red pixel data signal, a green pixel data signal and a blue pixel data signal;

x(R), x(G) and x(B) respectively represent horizontal coordinate values in the chromaticity coordinates system of the red pixel data signal, the green pixel data signal and the blue pixel data signal, y(R), y(G) and y(B) respectively represent longitudinal coordinate values in the chromaticity coordinates system of the red pixel data signal, the green pixel data signal and the blue pixel data signal.

15. The image displaying system according to claim 11, wherein the red pixel data signal is inputted to the first red sub-pixel unit of the second red sub-pixel unit, the green pixel data signal is inputted to the first green sub-pixel unit of the second green sub-pixel unit, the blue pixel data signal is inputted to the first blue sub-pixel unit of the second blue sub-pixel unit, and the fourth pixel data signal is inputted to the first red sub-pixel unit, the first green sub-pixel unit and the first blue sub-pixel unit of the fourth sub-pixel unit.

16. The image displaying system according to claim 15, wherein a calculating process of the gray scale X(gray) of the fourth pixel data signal carried out by the data signal processing unit comprises:

firstly setting a luminance of the fourth pixel data signal $Lv(X)=k\times(Lv(R)+Lv(G)+Lv(B))$ and a chrominance of the fourth pixel data signal $x(X)=f(x(R)+x(G)+x(B))$, $y(X)=f(y(R)+y(G)+y(B))$; and afterwards, carrying out a white balance calculation to obtain the gray scale of the fourth pixel data signal $X(gray)=a\times R(gray)+b\times G(gray)+c\times B\ (gray)$, where, f is a function representative of converting three-pixel data signals of the image into four-pixel data signals of the image;

Lv(R), Lv(G) and Lv(B) respectively represent a red pixel data signal, a green pixel data signal and a blue pixel data signal;

x(R), x(G) and x(B) respectively represent horizontal coordinate values in the chromaticity coordinates system of the red pixel data signal, the green pixel data signal and the blue pixel data signal, y(R), y(G) and y(B) respectively represent longitudinal coordinate values in the chromaticity coordinates system of the red pixel data signal, the green pixel data signal and the blue pixel data signal.

17. The image displaying system according to claim 12, wherein the red pixel data signal is inputted to the first red sub-pixel unit of the second red sub-pixel unit, the green pixel data signal is inputted to the first green sub-pixel unit of the second green sub-pixel unit, the blue pixel data signal is inputted to the first blue sub-pixel unit of the second blue sub-pixel unit, and the fourth pixel data signal is inputted to the first red sub-pixel unit, the first green sub-pixel unit and the first blue sub-pixel unit of the fourth sub-pixel unit.

18. The image displaying system according to claim 17, wherein a calculating process of the gray scale X(gray) of the fourth pixel data signal carried out by the data signal processing unit comprises:

firstly setting a luminance of the fourth pixel data signal $Lv(X)=k\times(Lv(R)+Lv(G)+Lv(B))$ and a chrominance of the fourth pixel data signal $x(X)=f(x(R)+x(G)+x(B))$, $y(X)=f(y(R)+y(G)+y(B))$; and afterwards, carrying out a white balance calculation to obtain the gray scale of the fourth pixel data signal $X(gray)=a\times R(gray)+b\times G(gray)+c\times B\ (gray)$, where, f is a function representative of converting three-pixel data signals of the image into four-pixel data signals of the image;

Lv(R), Lv(G) and Ly(B) respectively represent a red pixel data signal, a green pixel data signal and a blue pixel data signal;

x(R), x(G) and x(B) respectively represent horizontal coordinate values in the chromaticity coordinates system of the red pixel data signal, the green pixel data signal and the blue pixel data signal, y(R), y(G) and y(B) respectively represent longitudinal coordinate values in the chromaticity coordinates system of the red pixel data signal, the green pixel data signal and the blue pixel data signal.

* * * * *